United States Patent [19]

Tauzin

[11] 4,303,016

[45] Dec. 1, 1981

[54] ELEMENTARY CHAIR-LIFT CAB FOR TELPHER RAILWAY

[75] Inventor: Francis Tauzin, Veyrins, France

[73] Assignees: Pomagalski S.A.; Sigma Plastique, both of France

[21] Appl. No.: 89,343

[22] Filed: Oct. 30, 1979

[30] Foreign Application Priority Data

Oct. 31, 1978 [FR] France ..... 78 30863

[51] Int. Cl.[3] ..... B61B 7/00

[52] U.S. Cl. ..... 104/173 ST; 105/329 SC

[58] Field of Search ..... 187/9 R; 104/173 R, 104/173 ST, 174, 175, 180; 105/150, 329 SC, 322, 333; 297/17

[56] References Cited

U.S. PATENT DOCUMENTS

| | | | |
|---|---|---|---|
| 2,662,587 | 12/1953 | McIlvaine | 104/173 ST |
| 3,556,014 | 1/1971 | Rudkln, Jr. | 104/173 ST |
| 3,747,974 | 7/1973 | Tauzin | 105/329 SC |

FOREIGN PATENT DOCUMENTS

| | | | |
|---|---|---|---|
| 400219 | 4/1966 | Switzerland | 104/173 ST |

*Primary Examiner*—Robert J. Spar
*Assistant Examiner*—Kenneth Noland
*Attorney, Agent, or Firm*—William A. Drucker

[57] ABSTRACT

This chair-lift cab for telpher lines has its seat protected by a shell pivoted about a transverse axis close to its center of gravity, at the front end of a bow pivoted in turn about another transverse axis at the rear of the first axis and close to the center of gravity of the bow and shell assembly, the upper portion of the shell being connected laterally to the frame structure of the chair-lift by means of arms pivoted at their ends, so that the space in front of the seat is cleared when the shell is tipped to its open position as a consequence of its double rotation about the two transverse axes, thus providing a balancing action insensible to gravity and dynamic forces.

4 Claims, 4 Drawing Figures

ELEMENTARY CHAIR-LIFT CAB FOR TELPHER RAILWAY

BACKGROUND OF THE INVENTION

1. Field of the Invention

This invention relates in general to telpher railways and has specific reference to an improved chair-lift cab therefor which is intended to constitute each one of the carrier elements of the line, these elements being adapted on the one hand in actual service to receive ski-wearing passengers stepping in while the chair-lift cab is running, and on the other hand when inoperative to be shunted at one end of the line. More particularly, this invention is directed to a telpher line car of the so-called chair-lift cab type, provided with a front protection portion or shell adapted to be cleared upwardly preferably under the control of automatic means closing and opening automatically all the elements' shells at the starting and arrival stations of the telpher line.

It is notorious that during the operation of a telpher line the cars, cabs or like gondolas are subjected to considerable stress due for instance to the weight of the shell, to the wind force and/or to substantial accelerations and decelerations most likely to disturb or act against the movements of the shell and chair-lift assembly, and it is the essential object of the invention to make the shells insensitive to disturbing forces and also to permit a satisfactory free or easy access to the seats by tilting the shells to their open position above the seats and enable the chair-lifts or cars of a telpher line to fit into one another so that they can be gathered under a shelter of reduced over-all or floor-space dimensions due to the possibility of stacking them very closely to one another, these advantageous results being obtained by using a particularly simple cab construction.

SUMMARY OF THE INVENTION

According to an essential feature characterising this invention, the protection shell associated with each chair-lift is an integral part of an assembly comprising an external bow, which is adapted to pivot in relation to the seat frame structure about a transverse horizontal axis adjacent the center of gravity of the assembly, the shell proper being furthermore capable of rotating in relation to its carrier bow about another transverse horizontal axis adjacent the center of gravity of the shell while being guided by lateral arms each pivoted to the shell and to the seat frame structure. With this arrangement affording a double shell rotation the resultant movement of the shell is a tipping movement causing it to pivot through an arc considerably longer than the angle of rotation of the shell-supporting bow, the two rotational movements about axes located in the vicinity of the aforesaid center of gravity providing a static equilibrium indifferent to starting, stopping and rocking or swinging accelerations. On the other hand, the upward clearing of the shell which results from the opening tipping movement provides a particularly easy access to the passenger seats in the open position, and moreover this feature facilitates greatly the interfitting of successive chair-lift cars in their open condition at the storage station, due to the outflaring configuration of each individual element.

According to a complementary feature characterising this invention, the shell supporting bow may advantageously have the general configuration of an external half-ring encompassing the rear portion of the seat and comprising a rear balancing weight such that the center of gravity of the assembly comprising the shell and its carrier bow is so positioned that the rotation of this assembly about a transverse horizontal axis coincident with this center involves a tipping of the shell through a relatively wide angle while minimizing the over-all dimensions of this shell.

The means for automatically controlling the tipping of the shell may be of any suitable and known type, and act preferably through the medium of a push-pull transmission cable responsive to a roller controlled by fixed guide rails; however, according to an advantageous complementary feature of the chair-lift cab of this invention, each shell opening and closing movement is controlled jointly by a cam rail starting the desired movement and by another counter-rail subsequently acting in the opposite direction so that the movement begins with a gradually increasing velocity and ends with a gradually decreasing speed.

In order to afford a clearer understanding of this invention, a typical and exemplary form of embodiment thereof will now be described with reference to the diagrammatic drawing attached hereto.

DESCRIPTION OF THE PREFERRED EMBODIMENT

Figure 1:
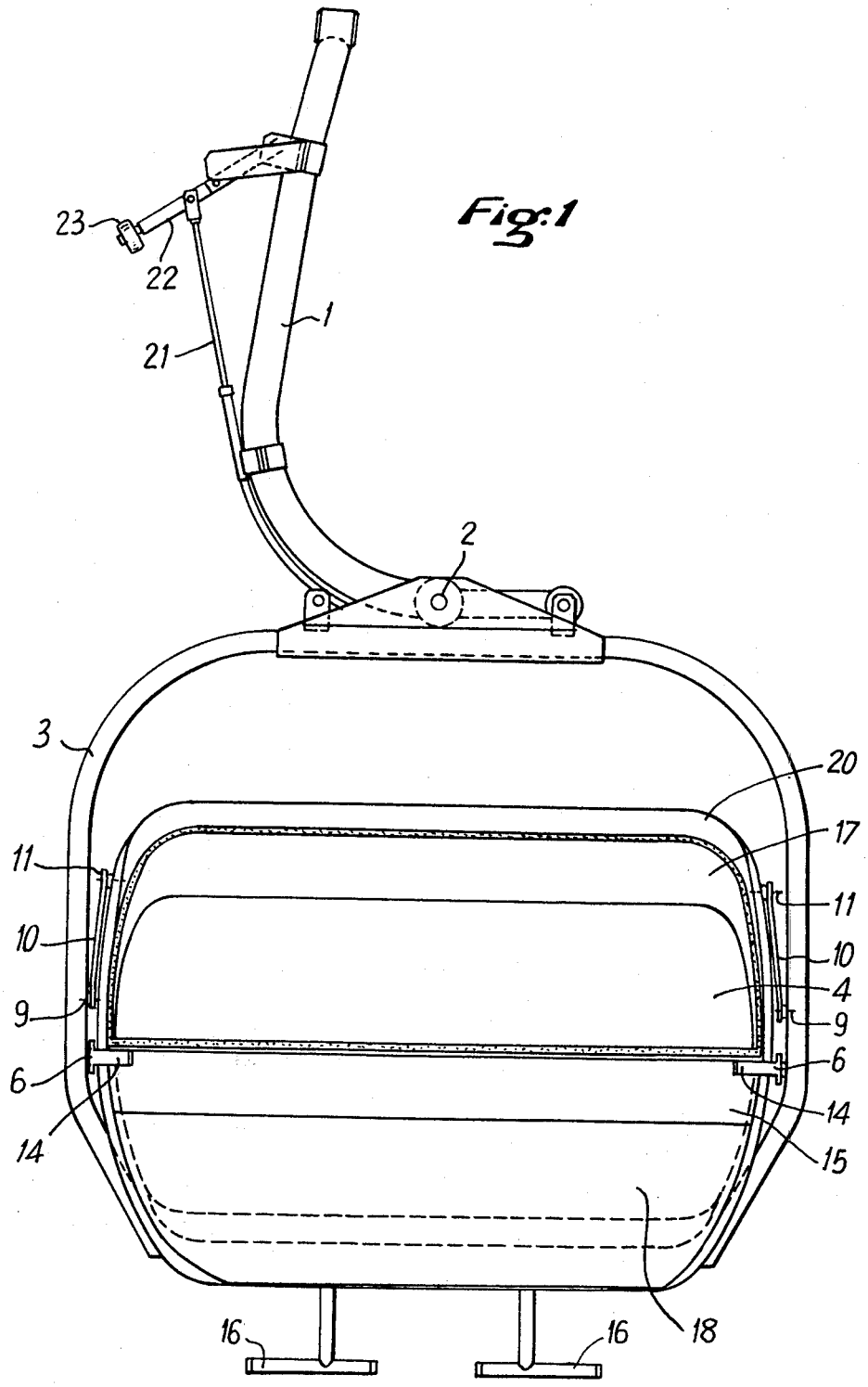
FIG. 1 is a front elevational view of a chair-lift cum cab assembly according to the invention, shown in its closed condition.

The reference numeral 1 designates the hanger suspended from the carrier and traction cable of a telpher line (not shown) through suitable means (also not shown), the lower portion of this hanger 1 supporting at 2 the transverse metal frame 3 of the bucket-seat 4 consisting for example of laminated polyester. The frame 3 is provided on either lateral sides with a gusset-plate 5 to which are pivoted on the one hand at 6 the assembly comprising the bow 7 and the protection shell 8, and on the other hand at 9 one end of a coupling arm 10 having its other end pivoted at 11 to the upper portion of shell 8. The bow 7 encompasses the rear portion of the seat and to this end has a semi-circular configuration as shown at 12, the side arms of this bow having front extensions 13 pivotally connected at their front ends to pivot pins 14 carried by the shell 8. The half-ring 12 comprises at the rear a balance weight so calculated that the common transverse pivot axis of the lateral pivot means 6 is more or less coincident with the center of gravity of the assembly 7–8 and the common transverse axis of said lateral pivot pins 14 is at least substantially coincident with the center of gravity of the shell 8.

The shell 8 advantageously comprises a body 15, for example of laminated polyester material, provided at its bottom with foot-rests 16 and at its upper portion with a wide windshield 17 of transparent material. In the exemplary form of embodiment illustrated the body 15 is a one-piece structure and comprises a lower, skirt-forming portion 18 leaving at its bottom, between the seat 4 and shell 8, an aperture for the passengers' legs, and also side posts 19 and a roof 20. Of course, the seat 4 may be designed for receiving two or three passengers sitting side-by-side.

Figure 4:
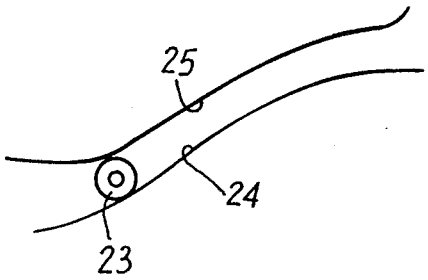
FIG. 4 is a diagram of a cam rail with a counter-rail associated therewith for automatically controlling the shell opening movement.

The means for automatically tipping the shell 8 comprises a known type of flexible transmission cable 21 driven from a pivoted arm 22 provided with a roller 23 adapted to be actuated by fixed guide rails provided at the ends of the telpher line. Each rail system (FIG. 4) comprises an actuator ramp 24 for starting the desired shell opening or closing movement, and a retaining counter rail 25. The rail profiles are so designed that each shell tipping movement begins at a gradually increasing speed and terminates at a gradually decreasing speed.

Figure 2:
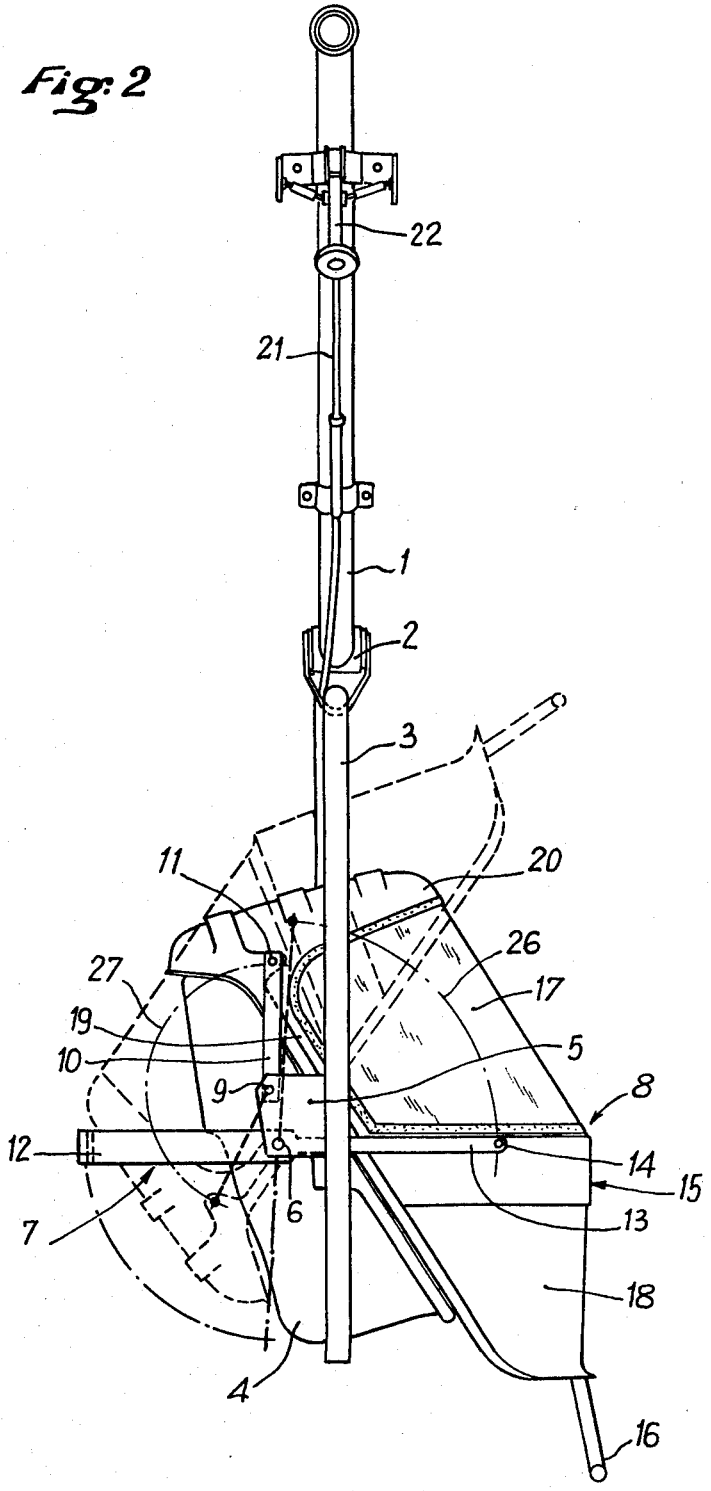
FIG. 2 is a side elevational view taken from the left-hand side of FIG. 1, showing the shell in its open position in phantom lines.
Figure 3:
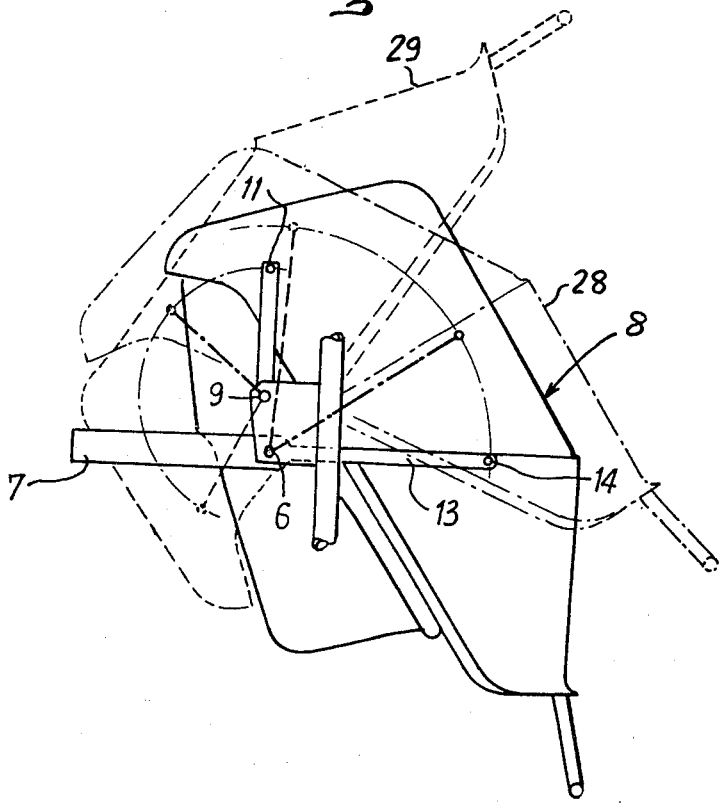
FIG. 3 is a simplified and more diagrammatic view showing the compound movement of the shell to and from its two endmost closed and open positions, with an intermediate position.

In FIG. 2 the circular path described by the pivot pins 14 about the axis 6 is designated by the reference numeral 26, and the circular arc described by the pivot pins 11 about the axis 9 is shown at 27, each intermediate position of the shell such as the position shown at 28 in FIG. 3 being determined by the engagement of the constant segment 11–14 between these two circular arcs 26 and 27, and it is clear that to a total rotation of the assembly 7,8 of the order of a quarter revolution on the circular path 26 there corresponds a resultant tipping movement of shell 8 through a considerably greater angle, whereby in its fully open position this shell clears completely the front of seat 4 and terminates its opening movement in the inverted position 29 inclined considerably to the rear and above the seat 4. Moreover, this open position 29 imparts to the assembly an outflared profile widely open to the front, so that the interfitting of the successive, inoperative chair-lifts can be gathered under shelter within a relatively reduced floor space.

Of course, various modifications and changes may be brought to the specific and preferred form of embodiment of the invention shown and described herein without departing however from the basic principles of the invention as set forth in the appended claims.

What I claim is:

1. A chair-lift cab, for a telpher line, comprising:

(i) a hanger (ii) a seat frame suspended from said hanger and including a pair of spaced supports, (iii) a seat integral with said seat frame and positioned with one of said supports at each side of the seat, (iv) a supporting bow rearwardly encompassing said seat and including a pair of lateral arms each of which is pivotably connected to a respective one of said supports for pivoting of the bow about a first pivot axis, each said lateral arm including a portion thereof projecting forwardly of said first pivot axis, (v) a rigid protection shell disposed in front of said seat and connected by pivot means to said forwardly projecting portions for pivoting of said shell about a transverse axis adjacent to its centre of gravity, (vi) a pair of coupling arms disposed one at each side of said shell, each coupling arm having one end pivotably connected to a respective support for movement about a second pivot axis, each coupling arm having its other end pivotably connected to an upper part of the protection shell, whereby the shell is movable between an opened position, in which it is moved away from the front of the seat to permit ingress and exiting of passengers, and a closed position in which it forms with the seat a closed housing, the rotation of the supporting bow through a given angle in the direction to open the shell resulting in rotation of the shell through a greater angle such that ingress and exiting of passengers, and fitting of cabs one into another for storage, are facilitated.

2. A chair-lift cab, as claimed in claim 1, comprising means for controlling the opening and closing movements of the shell, said means comprising:

(a) an arm pivoted at a first end to the hanger, (b) a roller on a second end of said arm, (c) a flexible transmission cable connecting said arm and said shell, (d) guide means, at each station of the telpher line at which the shell is to be operated, positioned for contacting by said roller, said guide means including cam rails and associated counter-rails for starting pivoting movement of the shell, said guide means being shaped to cause said pivoting movement to commence with a gradually increasing velocity, and to terminate with a gradually decreasing velocity.

3. A chair-lift cab, as claimed in claim 2, comprising a balance weight on a rearward part of said supporting bow, said weight being selected such that the center of gravity of the assembly of bow and shell closely coincides with the axis of pivoting of the bow.

4. A chair-lift cab, as claimed in claim 1, comprising a balance weight on a rearward part of said supporting bow, said weight being selected such that the center of gravity of the assembly of bow and shell closely coincides with the axis of the pivoting of the bow.

* * * * *